US005660004A

United States Patent [19]

Blackmon et al.

[11] Patent Number: 5,660,004

[45] Date of Patent: Aug. 26, 1997

[54] ROOFING SYSTEM FOR PROTECTING FLAT ROOFS OR SLIGHTLY SLOPED ROOFS, METHOD OF APPLICATION OF SAID NEW ROOFING SYSTEM AND METHOD FOR REROOFING USING SAID NEW ROOFING SYSTEM

[76] Inventors: Craig Lindsay Blackmon, 716 E. 12½ St., Houston, Tex. 77008; David A. Lund, 8103 Schaffer Ln., Houston, Tex. 77070

[21] Appl. No.: 413,795

[22] Filed: Mar. 30, 1995

[51] Int. Cl.[6] ..... E04B 7/02

[52] U.S. Cl. ..... 52/90.2; 52/746.11

[58] Field of Search ..... 52/90.2, 91.1, 52/90.1, 94, 95, 262, 263, 54, 43, 47, 198, 741.1, 746.1, 746.11

[56] References Cited

U.S. PATENT DOCUMENTS

| | | | |
|---|---|---|---|
| 4,128,984 | 12/1978 | Charbonneau et al. | 52/746 |
| 4,423,572 | 1/1984 | Tor | 52/94 |
| 4,570,396 | 2/1986 | Struben | 52/90.2 |
| 4,608,791 | 9/1986 | McClure | 52/90 |
| 4,642,950 | 2/1987 | Kelly | 52/90 |
| 4,831,794 | 5/1989 | Perry | 52/90 |
| 4,864,781 | 9/1989 | Emblin | 52/58 |
| 4,890,427 | 1/1990 | Rayburn | 52/90.2 |
| 5,222,337 | 6/1993 | Thomson et al. | 52/404 |
| 5,277,002 | 1/1994 | Haag | 52/90.1 |

OTHER PUBLICATIONS

"Tear Off or recover?", Robert M. Haddock, Part I and Part II, Jul. 1994 & Aug. 1994, pp. 24–40.

*Primary Examiner*—Carl D. Friedman
*Assistant Examiner*—Creighton Smith
*Attorney, Agent, or Firm*—Maryann Bani-Jamal

[57] ABSTRACT

This invention provides a new roofing system for protecting flat roofs or slightly sloped roofs. This invention also features a method of roofing and a method of reroofing using a new roofing system, said method comprising:

(a) removing and relocating debris, including but not limited to leaves and loose roof gravel, from top of a building;

(b) using an existing horizontal roof deck as a lower surface of said new roofing system;

(c) fastening a horizontal roof support to said horizontal roof deck, and to any ceiling joists lying under the horizontal roof deck, using fasteners;

(d) fastening metal sheets to the horizontal roof support using fasteners, said metal sheets inclining upwards from a number of longitudinal outer edges of the lower surface towards a central section of the new roofing system forming a left upper surface and a right upper surface, with a gap existing at the central section between the left upper surface and the right upper surface of the new roofing system;

(e) using a number of ridge caps to cover said gap at the central section which is located between the left upper surface and the right upper surface after having placed a number of two-way vents for transmission of air and moisture on the lower surface and at the central section of said new roofing system;

(f) setting air conditioning compressors above metal sheets after supplying additional support under said air conditioning compressors and above said metal sheets;

(g) sealing existing functional vents, and additional vents that are needed, to the metal sheets at the left upper surface and at the right upper surface of the new roofing system; and (h) attaching prefinished compatible metal gutters to a number of outer edges of the new roofing system such that said metal gutters surround the metal sheets and, thus, the building above which said metal sheets are installed, utilizing a number of down spouts when appropriate and supplying a number of new down spouts when needed and connecting said number of down spouts to the metal gutters.

14 Claims, 3 Drawing Sheets

ROOFING SYSTEM FOR PROTECTING FLAT ROOFS OR SLIGHTLY SLOPED ROOFS, METHOD OF APPLICATION OF SAID NEW ROOFING SYSTEM AND METHOD FOR REROOFING USING SAID NEW ROOFING SYSTEM

BACKGROUND OF THE INVENTION

1. Field of the Invention

This invention relates to a new roofing system for protecting flat roofs or slightly sloped roofs, a method of application of said new roofing system and a method for reroofing using said new roofing system.

2. General Background

For many years coal tar pitch roofs were used. Prior to and in the 1960s and 1970s, flat roofs, with little or no slope, were very popular. One major problem with flat gravel and tar roofs is collection of water upon the roofs. Flat roofs have ineffective drainage characteristics and thus leakage problems. Thus, flat roofs have lost popularity in the past years.

Currently used roofing systems have a wide variety of shapes and forms. Reroofing may be costly to an owner and risky to a roofing contractor if not performed properly and if performed with unsuitable systems, resulting in millions of dollars of liability to the roofing contractor. Recently, modified pitched roofs comprising slopes to ensure positive drainage have been gaining popularity over previous roofs with little slope or with no slope. The present invention relates to a new roofing system for protecting flat roofs or slightly sloped roofs, a method of application of said new roofing system and a method for reroofing using said new roofing system. Said new roofing system uses a modified pitch which helps in avoiding ponding and thus increasing roof life. Also, the new roofing system can provide greater insulation characteristics. Construction and format of the new roofing system lowers utility consumption by decreasing temperature changes.

Metal sheets, used as an upper surface in the new roofing system which is put over a lower surface including but not limited to a tar and gravel covered lower surface, are essential to the new roofing system. Said metal sheets have a perimeter comprising a number of inner borders and a number of outer borders. Said new roofing system most preferably comprises, in addition to said metal sheets, a horizontal roof support placed longitudinally on the lower surface of the new roofing system, a horizontal roof deck, a central section and fasteners. A number of outer edges, comprising a number of longitudinal outer edges and a number of latitudinal outer edges, surround the lower surface of the new roofing system. The fasteners are utilized for fastening the horizontal roof support to the horizontal roof deck, and thus to underlying ceiling joists. The metal sheets are fastened to the horizontal roof support laid down between each of the number of longitudinal outer edges of the lower surface of the new roofing system and the central section of the new roofing system. A number of ridge caps is then used to connect to one another "opposite pairs of metal sheets" (i.e. metal sheets running from opposite pairs of the number of longitudinal outer edges of the lower surface of the new roofing system to the central section of the new roofing system) by covering the number of inner borders of each metal sheet located along the central section of the new roofing system, thus connecting one of the number of inner borders of each metal sheet to one of the number of inner borders of the opposite metal sheet.

The horizontal roof support comprises sets of wooden rafters or sets of metallic beams (said sets of wooden rafters or said sets of metallic beams generally referred to as "sets of beams"), with each set of beams located at a specified distance from the adjacent set of beams. Each set of beams contains an increased amount of material, whether treated wood or metal is being used, than the previous set of beams as one proceeds towards each of the number of ridge caps from each of the number of longitudinal outer edges of the lower surface of the new roofing system. On the other hand, each set of beams contains a decreased amount of material, such as treated wood or metal, than the previous set of beams as one proceeds away from each of the number of ridge caps towards each of the number of longitudinal outer edges of the new roofing system. As one proceeds parallel to the central section and towards each of the number of latitudinal outer edges of the new roofing system, the sets of beams are equivalent in height. In addition, sheet rocks comprising plaster boards are placed vertically between metal sheets and between adjacent sets of beams, thus separating metal sheets from adjacent sets of beams. The sheet rocks, along with the sets of beams, separate metal sheets from the horizontal roof deck. In addition, as an option, insulation sheets may be used to separate the metal sheets from the horizontal roof deck. Generally, insulation sheets are usually used mostly over metal buildings, but metal buildings have no existing horizontal support in advance.

A number of two-way vents may be located under each of the number of ridge caps, said number of two-way vents permitting a flow of air under the metal sheets and under the number of ridge caps.

In a most preferred embodiment, a number of channels is positioned along the number of outer borders of the metal sheets. Said number of channels is referred to as a "metal gutter" when said number of channels is not entrapped between two roofs and is solely adjacent to the metal roof. Said metal gutter would thus be fastened to the metal roof by a sealant to prevent any entrance of extraneous matter under the metal sheets through the number of outer edges of the new roofing system. A channel may exist along the sides of a sloped roof or slightly sloped roof where said channel connects the sloped roof or the slightly sloped roof to the new roofing system. Said channel, referred to as a "trough", has a roof on two opposite sides and produces a more efficient drainage system for roofing systems with a number of parapets (i.e. a low wall to protect edge of a roof).

A method of application of a new roofing system to a building comprises:

(a) removing and relocating debris, including but not limited to leaves and loose roof gravel, from top of a building;

(b) using a horizontal roof deck upon ceiling joists such that said horizontal roof deck serves as a lower surface of said new roofing system;

(c) fastening a horizontal roof support to said horizontal roof deck, and thus to said underlying ceiling joists, using fasteners;

(d) fastening metal sheets to the horizontal roof support using fasteners, said metal sheets inclining upwards from a number of longitudinal outer edges of the lower surface towards a central section of the new roofing system forming a left upper surface and a right upper surface, with a gap existing at the central section between the left upper surface and the right upper surface of the new roofing system;

(e) using a number of ridge caps to cover said gap at the central section which is located between the left upper surface and the right upper surface after having placed a number of two-way vents for transmission of air and moisture on the lower surface and at the central section of said new roofing system;

(f) setting air conditioning compressors above metal sheets after supplying additional support under said air conditioning compressors and above said metal sheets;

(g) sealing existing functional vents, and additional vents that are needed, to the metal sheets at the left upper surface and at the right upper surface of the new roofing system; and (h) attaching prefinished compatible metal gutters to a number of outer edges of the new roofing system such that said metal gutters surround the metal sheets and, thus, the building above which said metal sheets are installed, utilizing a number of down spouts when appropriate and supplying a number of new down spouts when needed and connecting said number of down spouts to the metal gutters.

A method for reroofing using said new roofing system comprises the steps described above for the method of application of the new roofing system. The major difference between the method for reroofing using the new roofing system and the method of application of the new roofing system is noticeable from the entitlement of the methods. For reroofing, before construction of the new roofing system begins, an original flat or slightly sloped roof exists upon which the new roofing system will be built, thus making construction of a horizontal roof deck redundant. The original roof serves as the horizontal roof deck of the new roofing system. In addition, for reroofing, existing skylights, existing gutters and nonfunctioning vents from the original roof should be removed before the construction of the new roofing system is started.

3. Description of the Prior Art

For many years, built-up roofing systems, utilizing typically a deck of wood, have been used commonly. In the built-up roofing systems, which are constructed in place, the entire roof deck is covered by a continuous weather-proof membrane such as alternate layers of felt and asphalt. Gravel, rock or similar aggregate is then spread upon the applied membrane to create a resistance to wear resulting from weather changes and foot traffic or to add weight to resist wind uplift. As an option, thermal insulation has also been applied at the inner side of the decking to minimize heat transfer through the deck. Built-up roofing systems, however, present substantial problems of expansion and contraction where extreme temperature ranges of heat and cold are encountered.

Due to the problems created by built-up roofing systems, comprising problems of expansion and contraction, prefabricated roofing systems have been developed in the past several years. Substantial on-site construction is not required for prefabricated roofing systems. Said prefabricated roofing systems, however, have several disadvantages. Often, adequate sealing provisions are not provided for obstructions such as roof-mounted equipment and parapets. Thus, due to thermal movements of the roofing system, leakage can occur. Sometimes, complicated and expensive systems using sealing membranes are required over expanse of the roofing system due to difficulty in achieving water-tight integrity of the roofing system.

In the past few years, there have been some improvements in roofing systems and in construction of the roofing systems. Numerous patents have been issued in regards to new roofing systems. Said patents disclose different innovations comprising new roofing systems, new methods of constructing said roofing systems and new methods of reroofing using said roofing systems.

Thomson et al., U.S. Pat. No. 5,222,337, discloses an insulation of flat roofs and a simultaneous construction of a gradient for positive drainage of the roofing placed on the insulation constituting a roofing layer, said roofing layer comprising rectangular elements arranged in rows parallel with the outer edges of the roof and each rectangular element having a greater thickness at two corners thereof than at opposite corners thereof.

Emblin, U.S. Pat. No. 4,864,781, discloses a multiple panel metal roofing system with overlapping panel edges, with the roofing system being installed on a continuous roof deck. Aligned support members form a support frame structure as a plurality of grid sections. Edges of planar outer skin sections overlap above the upper surface of the support members.

Perry, U.S. Pat. No. 4,831,794, discloses a system for forming a sloped surface on a pre-existing flat roof deck by using a mold assembly comprising angularly configured beams interconnected with baffle plates, such mold assembly to be filled with a light-weight cementitious or other operable material suitable for roofing.

Kelly, U.S. Pat. No. 4,642,950, discloses an arrangement and system provided for creating a sloping roof out of a flat roof and providing said sloping roof with slopes which merge into plateaus.

McClure, U.S. Pat. No. 4,608,791, discloses a fully adjustable, simplified system for setting up a sloping roof on top of an existing flat roof, wherein top and bottom roof spanning members are interconnected by individually vertically adjustable stanchions which are cross-braced in two orthogonal planes.

Tor, U.S. Pat. No. 4,423,572, discloses a water-tight insulated roof construction which utilizes an interlocking panel construction comprising a plurality of interlocking metallic panels fastened to an existing roof deck, a ridge cap, and heat insulating means positioned between said panels and said roof deck.

Charbonneau et al., U.S. Pat. No. 4,128,984, discloses a method of constructing a sloped roof by securing panels to purlins, said method comprising priming the surfaces of the purlins to be contacted by the roof panels with an organic solvent solution, allowing the solvent to volatilize, applying onto the primed surfaces a double-coated foam-backed pressure-sensitive adhesive tape, peeling away the low-adhesion web, and laying the roof panels against the exposed surface of the pressure-sensitive adhesive tape.

Each of the above mentioned patents discloses various features of a number of inventions. However, the known prior art suffers certain disadvantages. The goal of the present invention is to cure said disadvantages.

SUMMARY OF THE INVENTION

A primary object of this invention is to provide a new roofing system which protects roofs and which is cost-efficient.

Another object of this invention is to provide a new roofing system which lowers utility consumptions by keeping temperature changes at a minimum level, leading to more financial savings.

A further object of this invention is to provide a new roofing system which prevents ponding in or on the roof and which is reliably moisture-tight.

Still another object of this invention is to provide a new roofing system which is compatible with various building sizes, shapes and constructions.

An additional object of the invention is to provide a new roofing system that can have any desired drainage slope using a correct setup of components.

Yet another object of the invention is to provide a new roofing system which can be easily and efficiently installed and repaired, preferably with a minimum amount of labor, material and skill.

Another object of the invention is to provide a new roofing system wherein damaged elements may be easily and efficiently replaced.

A further object of this invention is to provide a new roofing system that provides a relatively noise-free roofing system.

Another object of the invention is to provide a new roofing system which allows expansion and contraction, thus reducing damages caused by temperature changes.

Still another object of the invention is to provide a new roofing system which withstands wind uplift.

A further object of the invention is to provide a new roofing system which is environmental friendly.

An additional object of this invention is to provide a roofing system which allows air-conditioners to remain on and attached to the system.

Another object of this invention is to provide a method of application of said new roofing system.

A final object of this invention is to provide a method of reroofing using said new roofing system, said method of reroofing using an originally existing roof upon which the new roofing system is built.

Additional objects and advantages of the invention will be set forth in part in a detailed description which follows, and in part will be obvious from the description, or may be learned by practice of the invention.

This invention provides a new roofing system forming a sloped left upper surface and a sloped right upper surface, said new roofing system used as a permanent installation on a pre-existing or original roof of a building structure or on a new building structure. Metal sheets are fastened to a horizontal roof support and connect a number of longitudinal outer edges of a lower surface of the new roofing system to a central section of the new roofing system. Each of a number of ridge caps connects to one another opposite pairs of metal sheets running from opposite pairs of the number of longitudinal outer edges of the lower surface of the new roofing system to the central section by covering one of the number of inner borders, of said opposite pairs of metal sheets, along and closest to the central section of the new roofing system. The horizontal roof support is placed in sets of beams, with each set of beams located at a specified distance from the adjacent set of beams. A number of two-way vents, located under each of the number of ridge caps, permits flow of air and moisture under the metal sheets and under the number of ridge caps. A new metal gutter, fastened to the established metal sheets by a sealant to prevent any flow of extraneous matter through the number of outer edges of the lower surface of the new roofing system, surrounds the established metal sheets. A number of troughs may be used as a substitute for part of the new metal gutter at the number of outer borders, of the metal sheets, shared by a number of parapet walls and the new roofing system. In mansard roofs, a trough is not used and the new roofing system is attached to an adjacent roof as shown in FIG. 2.

This invention also features a method of application of a new roofing system for protecting roofs of buildings. Said method comprises several steps. Debris is removed from top of a building. A horizontal roof deck is placed upon ceiling joists, with said horizontal roof deck serving as a lower surface for the new roofing system. Upon fastening a horizontal roof support to the horizontal roof deck, metal sheets are fastened to the horizontal roof support using fasteners. The metal sheets preferably are adjusted to incline from a number of longitudinal outer edges of the lower surface towards a central section of the new roofing system forming a left upper surface and a right upper surface, with a gap existing between the left upper surface and the right upper surface of the new roofing system. Then, a number of ridge caps is used to cover the gap at the central section which is located between the left upper surface and the right upper surface upon placing a number of two-way vents for flow of air and moisture at the central section. Air conditioning compressors are placed above metal sheets, with additional support being supplied under said air conditioning compressors and above said metal sheets. Existing functional vents and any necessary additional vents are then sealed to the metal sheets at the upper surface of the new roofing system. Finally, prefinished compatible metal gutters are attached to the number of outer edges of the new roofing system such that said metal gutters surround the metal sheets and, thus, the building above which said metal sheets are installed, utilizing an existing number of down spouts when appropriate and supplying a number of down spouts when needed and connecting said number of down spouts to the metal gutters.

A method for reroofing using said new roofing system is very similar to the method of application of the new roofing system, except that for reroofing an original roof exists before construction of the new roofing system starts.

As can be seen, the roofing structure is of simple construction and economical, since it can be built from a relatively small amount of material with relatively little labor. It is to be understood that the descriptions of this invention are exemplary and explanatory, but are not restrictive, of the invention. Other objects and advantages of this invention will become apparent from the following specification and the accompanying drawings.

BRIEF DESCRIPTION OF DRAWINGS

The accompanying drawings, which are incorporated in and constitute a part of this specification, illustrate examples of preferred embodiments of the invention and, along with the description, serve to explain the principles of the invention. The same characters of reference are employed in the drawings to indicate corresponding similar parts throughout the drawings.

FIG. 4(*b*) is an enlargened view of a corner of FIG. 4(*a*).

DETAILED DESCRIPTION OF THE PREFERRED EMBODIMENT

Figure 2:
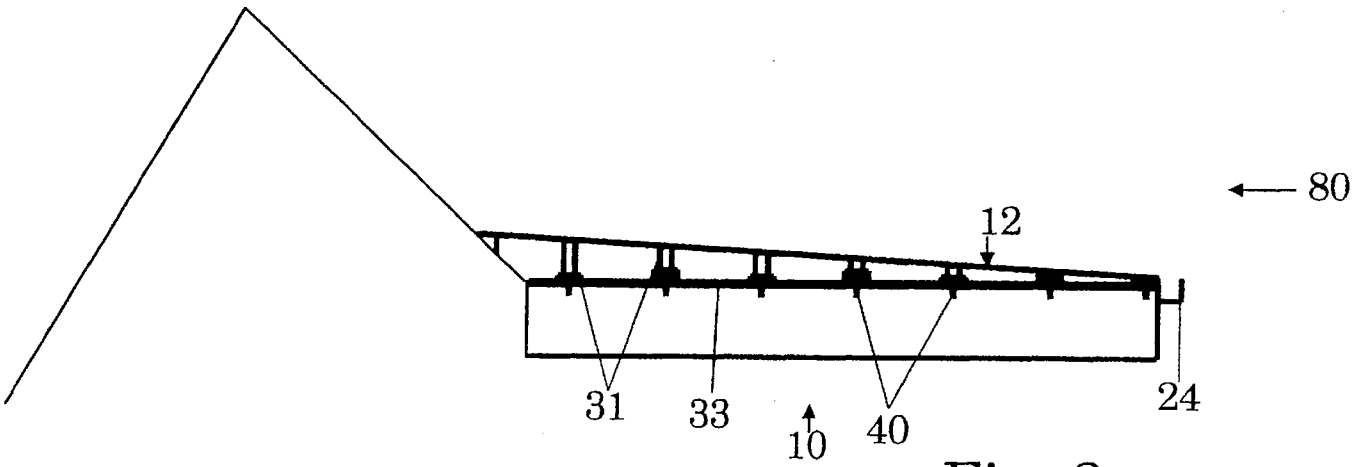
FIG. 2 is a cross-sectional view of a mansard roof using a version of the new roofing system and containing a number of troughs.
Figure 3:
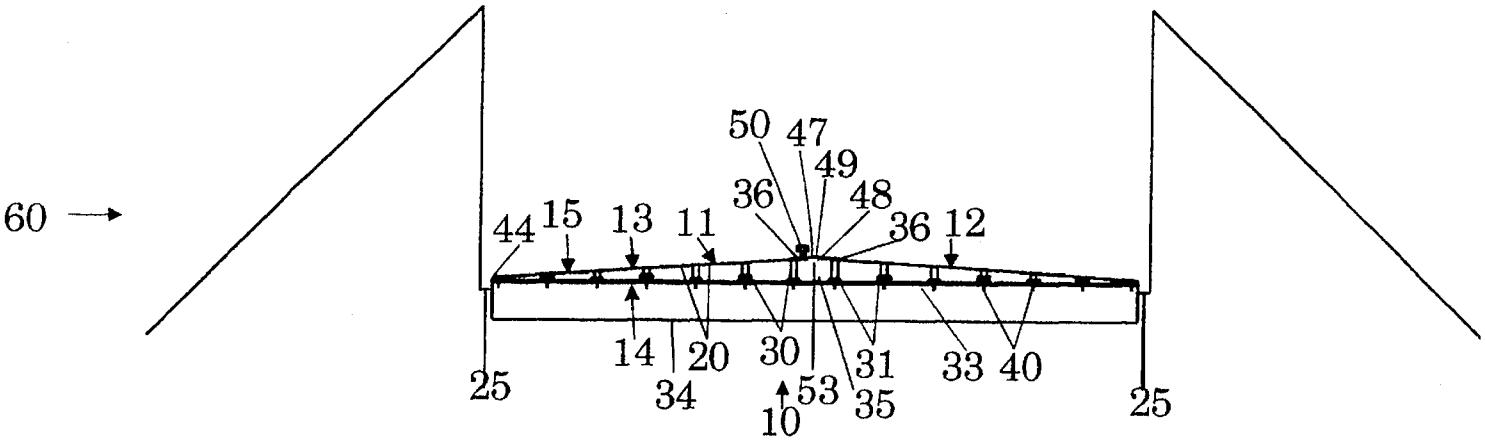
FIG. 3 is a cross-sectional view of the new roofing system with a number of parapet walls and containing a number of troughs.
Figure 4A:
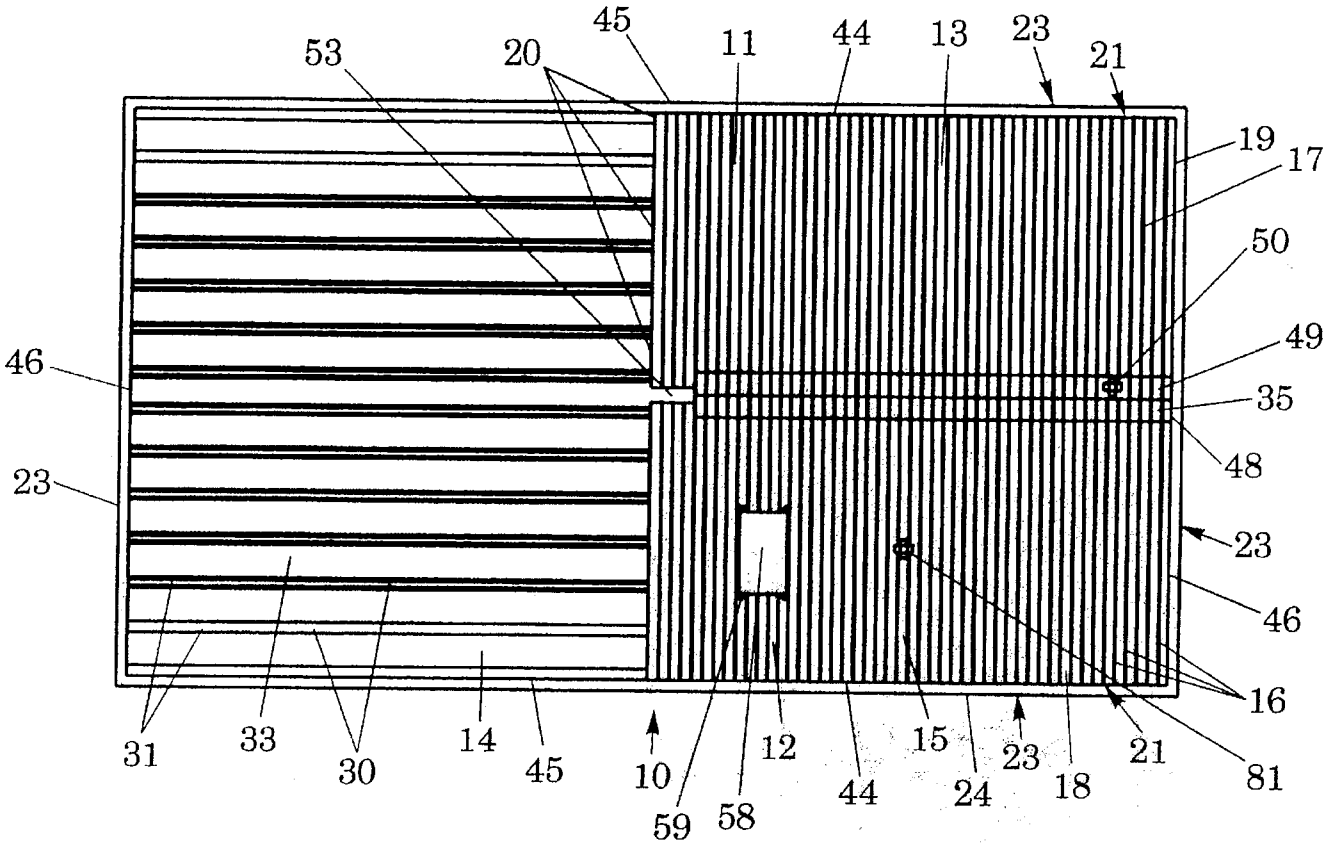
FIG. 4(*a*) is a top view of the preferred embodiment of the new roofing system shown in FIG. 1 before completion of and during construction.
Figure 4B:
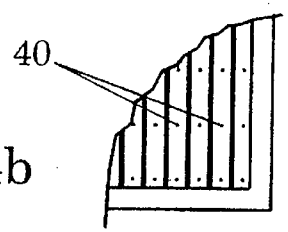

Several preferred embodiments of the present invention are illustrated in the attached drawings. Every component is not included in every version and every view of the embodiments, and thus some drawings may be missing some components. The drawings illustrate a new roofing system 10 with numerous applications. Said new roofing system 10 may be used to cover a large variety of flat and low-pitched roofs. In addition, said new roofing system 10 may be combined with numerous substrates and building configurations. Both free-standing buildings and flat and low-pitched roofs attached to taller buildings may use advantages provided by the new roofing system 10. Applying special considerations, even buildings with roofs that have parapet walls 60 (refer to FIG. 3) and with mansard roofs 80 (refer to FIG. 2) may enjoy the benefits of the new roofing system 10. Previous problems created by most small air conditioning units, skylights and roof protrusions are not major concerns for a user of the new roofing system 10.

Figure 1:
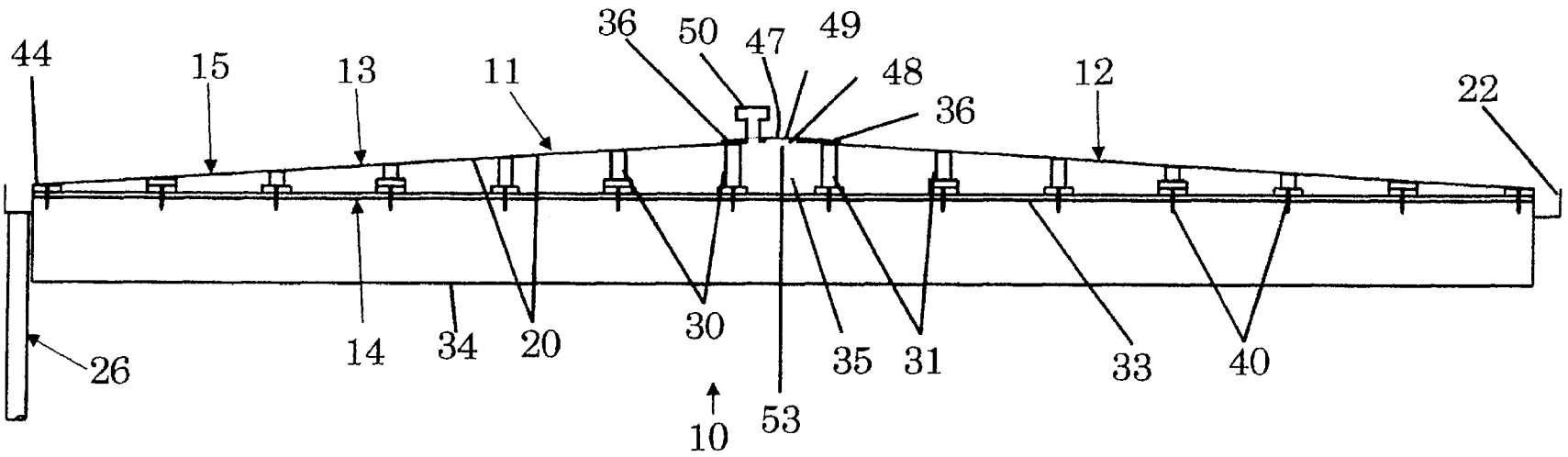
FIG. 1 is a latitudinal cross-sectional view of a preferred embodiment of the new roofing system.

As shown in FIG. 1, said new roofing system 10 has an upper surface 13 and a lower surface 14, with the upper surface 13 having a left upper surface 11 and a right upper surface 12. Metal sheets 15 are used as the upper surface 13 in the new roofing system 10 and are put over original roofs, usually old tar and gravel covered roofs, which serve as the lower surface 14. Said upper surface 13 is a major element of said new roofing system 10. In a most preferred embodiment, the metal sheets 15 comprise a number of ribs 16 laid at specified distances from each other, giving the metal sheets 15 a series of elevated sections 17 with a shallow section 18 located between each pair of said series of elevated sections 17. Said metal sheets 15 have a perimeter 19 comprising a number of inner borders 20 and a number of outer borders 21, with the number of inner borders 20 being borders of the metal sheets 15 which are located adjacent to a neighboring metal sheet 15 and with the number of outer borders 21 being borders of the metal sheets 15 which are located adjacent to channels 23, said channels 23 comprising gutters 22 (not shown), most preferably metal gutters 24, and troughs 25. In addition, said new roofing system 10 most preferably comprises a horizontal roof support 30 placed longitudinally on the lower surface 14 of the new roofing system 10, a central section 35, a horizontal roof deck 33 and fasteners 40. Said horizontal roof support 30 comprises sets of beams 31, said sets of beams 31 including but not limited to metallic beams and beams made of treated wood, with the treated wood preferably being plywood. Application of treated wood is a major factor in deterring presence of termites. Said fasteners 40 comprise deck screws (or metal-to-wood screws) for fastening the sets of beams 31 to the horizontal roof deck 33, and thus to underlying ceiling joists 34. Rubberwashers are placed around fasteners 40 for protection against entrance of water.

The horizontal roof deck 33, which neighbors ceiling joists 34, may serve as the lower surface 14 of the new roofing system 10. The number of outer edges 44 of the lower surface 14 comprises a number of longitudinal outer edges 45 and a number of latitudinal outer edges 46. The metal sheets 15 are fastened to the horizontal roof support 30, with the horizontal roof support 30 being laid down between each of the number of longitudinal outer edges 45 of the lower surface 14 and the central section 35 of the new roofing system 10. Long deck screws are preferably used as fasteners 40 to connect the metal sheets 15 to the horizontal roof support 30. Each of a number of ridge caps 49, with a left end 47 and a right end 48, is then used to connect opposite pairs of metal sheets 15 to one another. Said opposite pairs of metal sheets 15 run from opposite pairs of the number of longitudinal outer edges 45 of the new roofing system 10 to the central section 35 of the new roofing system 10, thus connecting one of the number of inner borders 20, located closest to the central section 35, of each metal sheet 15 to one of the number of inner borders 20, located closest to the central section 35, of the opposite metal sheet 15. The left end 47 of each of the number of ridge caps 49 is connected to an edge of the left upper surface 11 which is closest to the central section 35 (an edge of the left upper surface 11 or of the right upper surface 12 that is closest to the central section 35 is referred to as "central edge 36") and the right end 48 of each of the number of ridge caps 49 is connected to the central edge 36 of the right upper surface 12.

The horizontal roof support 30 is placed in sets of beams 31, with each set of beams 31 located at a specified distance from the adjacent set of beams 31. Each set of beams 31 contains an increased amount of material, comprising treated wood and metal, than the previous set of beams 31 as one proceeds towards each of the number of ridge caps 49 from each of the number of longitudinal outer edges 45 of the lower surface 14. On the other hand, each set of beams 31 contains a decreased amount of material, comprising treated wood and metal, than the previous set of beams 31 as one proceeds away from each of the number of ridge caps 49 towards each of the number of longitudinal outer edges 45 of the lower surface 14 of the new roofing system 10.

A number of two-way vents 50 may be located under each of the number of ridge caps 49. Said number of two-way vents 50 permits a flow of air and moisture under the metal sheets 15 and under the number of ridge caps 49.

Existing gutters may be removed while new gutters 22 are added. Gutters 22 act as channels 23 surrounding the upper surface 13 of the new roofing system 10, leading water and debris away from surface of metal sheets 15 and preventing accumulation of water and debris. In a preferred embodiment, a new metal gutter 24 surrounds the metal sheets 15. Said metal gutter 24 is fastened to the metal sheets 15 using sealants 55 (not shown) to prevent any entrance of extraneous matter under the metal sheets 15 through the number of outer edges 44 of the lower surface 14 of the new roofing system 10. Sealants 55, comprising mastic materials, and elastomeric roof caulks may serve to fasten edges of the metal gutters 24 to the number of outer borders 21 of the metal sheets 15, to edges of the left upper surface 11 and edges of the right upper surface 12, and to the number of longitudinal outer edges 45 and to the number of latitudinal outer edges 46 of the lower surface 14 in order to prevent leakage under the new roofing system 10. In addition, the number of outer borders 21 and the number of inner borders 20 of the metal sheets 15 of the new roofing system 10 are provided with sealants 55 to protect the new roofing system 10 from entrance of water and other extraneous matter. Cloth reinforcement is also available. Cloth reinforcement is a reinforced sponge-type cloth which is used as a sealant. Use of sealants 55 avoids use of nails or screw on the number of outer borders 21 of the metal sheets 15. On the number of inner borders 20 of the metal sheets 15, sealants 55 are used to avoid problems created by expansion and contraction through rupturing of joints and to make the new roofing system 10 as moisture-tight as possible. In addition to metal gutters 24, troughs 25 may be used as a substitute for the metal gutters 24 along number of outer borders 21 which are shared by other slightly sloped or sloped roofs. Examples of use of troughs 25 is for roofs with parapet walls 60 (refer to FIG. 3). A number of down spouts 26 are used at certain distances apart from each other and preferably on every side of the building to lead the debris and water from the gutters 22 and troughs 25 to the ground. For aesthetic reasons, the number of down spouts 26 are preferably included on back of the building and on sides of the building. In addition to the use of sealants 55 for prevention of moisture into the new roofing system 10, sealants 55 are also used for protection against windlifting. Elastomeric roof caulks, for example, may be embedded in reinforced cloth to decrease damages against strong winds. Foam products may also be used to cover the number of outer edges 44 of the lower surface 14 of the new roofing system 10 in order to decrease damages against strong winds. Along with use of the previous methods to protect the new roofing system 10 from moisture and wind damage, metal sheets 15 may also be curved at or tapered at the number of outer edges 44 of the lower surface 14 of the new roofing system 10. On gable sides of buildings, supports for the metal sheets 15 are cut back at an angle to allow the metal sheets 15 to be rolled down to meet the gutter 22 so that there are no gable sides to change architectural profile of ends of the building. In order to realize such curving and tapering at gable sides of a building, metal sheets 15 used at gable sides of the building differ in shape and size from other metal sheets 15. Metal sheets 15 used at gable sides are most preferably trapezoidal in shape to accommodate for increasing height of the slightly slanted new roofing system 10 and to provide an additional area to be rolled down the number of outer edges 44 of the lower surface 14 of the new roofing system 10.

Light gauge substructural components add slope to existing flat roof surfaces. A most preferred embodiment uses steel as the light gauge substructural component. Said slope created by the substructural components assists in creating new "ridges" above the previous flat roof surface. In a most preferred embodiment, the invention overlays existing gravel roofs with Galvalume® (Galvalume® being a registered trademark of BIEC International, Inc.) metal sheets (said metal sheets having a coating of a corrosion-resistant aluminum-zinc alloy which provides galvanic protection for the metal sheets) installed with a slope ranging from approximately ¼ in. per foot to approximately 1½ in. per foot from the central section 35 toward front of building and toward back of building, minimizing handling and cutting of insulation during placement of insulation in the new roofing system 10 while improving thermal insulation of the new roofing system 10. Said metal sheets 15 preferably have a vinyl backed 2-inch fiberglass insulation. A major advantage of Galvalume metal sheets is that Galvalume metal sheets are rust resistant. Said metal sheets 15 are placed over the gravel roofs after removal of loose gravel and construction of the horizontal roof support 30 to establish the desired slope. The horizontal roof deck 33 is attached to the ceiling joist 34. Upon installation of the metal sheets 15 on the horizontal roof support 30, air conditioning compressors 58 are set on top of metal sheets 15 and non-functioning vents are removed. The number of 2-way vents 50 are then sealed on the number of ridge caps 49. Existing functional plumbing vents 81 are preserved on the new roofing system 10.

Coated metal sheets may be used in lieu of galvanized metal sheets to improve corrosion resistance where debris comprising pine needles and leaves accumulate. In addition, use of coated metal sheets would eliminate "tin roof" appearance problems where portions of the new roofing system 10 are visible. Although the metal sheets 15 are fixed to the horizontal roof deck 33, a space always exists between the metal sheets 15 and the horizontal roof deck 33. Thus, a volume exists between each adjacent pair of the set of beams 31 of the horizontal roof support 30 which are fastened between the horizontal roof deck 33 and the metal sheets 15. Said volume increases from the number of longitudinal outer edges 45 of the new roofing system 10 to the central section 35 of the new roofing system 10 and decreases from the central section 35 of the new roofing system 10 to the number of longitudinal outer edges 45 of the new roofing system 10. Increase or decrease in the volume between each adjacent pair of the sets of beams 31 depends upon and is proportional to the slope desired for the upper surface 13 of the new roofing system 10, with an increase in slope of the upper surface 13 leading to an increase in volume and a decrease in slope of the upper surface 13 leading to a decrease in volume between each adjacent pair of the sets of beams 31. Intervals between each pair of said sets of beams 31 of said horizontal roof support 30 preferably ranges from approximately 2 ft. to approximately 4½ ft.

The entire new roofing system 10 becomes a permanent installation fixedly secured on the horizontal roof deck 33. The amount of slope of the upper surface 13 of the new roofing system 10 may vary. The most preferred embodiment has a slope ranging from approximately ⅛ in. per foot to approximately ½ in. per foot. Increase in slope from ⅛ in. per foot to ¼ in. per foot increases the volume of material used to create the slope, and thus increases the cost. Increase in slope to or above ½ in. per foot may be very effective in drainage but may become cost prohibitive. Haddock, Robert M., "Tear-off or recover? Find the answer with metal roofing", RSI, p. 25, July 1994. To create said slope of the upper surface 13, material comprising rigid insulation board or horizontal roof support 30 is used, said horizontal roof support 30 being preferably purchased per cubic foot. Since the volume of material needed increases proportionally to increase in the slope, cost of material needed for construction rises proportional to increase of slope. For example, tripling the slope most probably requires tripling the material needed and thus tripling the cost of material.

It should be noted that Mr. Haddock's article of July 1994 and another one of his articles dated August 1994, which is cited below, describe a metal roofing system similar to the present invention. However, the new roofing system 10 described in the present invention has been built in Houston, Tex., since Mar. 31, 1994, predating Mr. Haddock's articles, and since Mar. 31, 1994, has been continuously and repeatedly built and finalized for different condominium units and other building structures. In addition, Mr. Haddock's article does not specifically describe the new roofing system 10 described in the present invention.

Said new roofing system 10 also provides support for air conditioning compressors 58. Additional support 59 is placed above metal sheets 15, said support 59 preferably comprising pieces of wood. The air conditioning compressors 58 are placed on top of said support 59 to minimize contact between the air conditioning compressors 58 and the metal sheets 15.

In addition, a method of application of a new roofing system 10 is included as an invention. Debris, including but not limited to leaves and loose roof gravel, is removed and relocated. Then, a horizontal roof deck 33 is placed upon built ceiling joists 34, with said horizontal roof deck 33 serving as a lower surface 14 of the new roofing system 10. A horizontal roof support 30 is then fastened to the horizontal roof deck 33, and thus to said underlying ceiling joists 34, using fasteners 40. Said fasteners 40 comprise long roof deck screws. In the next step, metal sheets 15 are attached to the horizontal roof support 30 using fasteners 40, preferably long roof deck screws. At this point, said metal sheets 15 should incline from a number of longitudinal outer edges 45 towards a central section 35 of the new roofing system 10 forming a left upper surface 11 and a right upper surface 12.

Upon adjustment of said metal sheets 15 upon the horizontal roof support 30, a gap 53 would exist between the left upper surface 11 and the right upper surface 12 of the new roofing system 10. A number of two-way vents 50, used for air flow ventilation and for transmission of air and moisture, are established at the gap 53 located at the central section 35 of the new roofing system 10. A number of ridge caps 49 are used to cover said gap 53 which is located at the central section 35 of the new roofing system 10. The number of two-way vents 50 would thus be placed on the number of ridge caps 49. After the metal sheets 15 are adjusted, air conditioning compressors 58 are set above metal sheets 15. Additional support 59 is supplied under said air conditioning compressors 58 and above said metal sheets 15. Existing number of two-way vents 50 that are still functional, and additional number of two-way vents 50 that are needed, are sealed to the metal sheets 15 at the upper surface 13 of the new roofing system 10. Finally, prefinished compatible channels 23 are attached to number of outer edges 44 of the lower surface 14 of the new roofing system 10 such that said channels 23 neighbor the number of outer borders 21 of the metal sheets 15 that are not shared with other adjacent, attached roofs (i.e. in mansard roofs 80 shown in FIG. 2, where tying into mansard roofs is a one-way slope with gutter 22 at one end, and roofs with parapet wails 60 shown in FIG. 3). Thus, the metal gutters 24 surround the building above which said metal sheets 15 are installed when neither mansard roofs 80 (refer to FIG. 2) nor roofs with parapet walls 60 (refer to FIG. 3) exist. The metal gutters 24 utilize a number of down spouts 26 remaining from the original roof when appropriate and add a number of down spouts 26 when needed. Said number of down spouts 26 are connected to the metal gutters 24, considering, among other issues, smooth flow and ejection of extraneous matter and aesthetic factors.

A method for reroofing using said new roofing system comprises the steps described above for the method of application of the new roofing system. The major difference between the method for reroofing using the new roofing system and the method of application of the new roofing system is noticeable from the entitlement of the methods. For reroofing, before construction of the new roofing system begins, an original roof exists upon which the new roofing system will be built, thus making construction of a lower surface redundant. The original roof serves as the lower surface of the new roofing system. In addition, existing skylights, existing gutters and nonfunctioning vents from the original roof should be removed before the construction of the new roofing system is started.

The invention also illustrates a method of reroofing using a new roofing system 10. To perform reroofing using the new roofing system 10, loose roof gravel is removed and relocated. A horizontal roof deck 33 is placed upon ceiling joists 34, establishing a slope ranging from approximately ¼ in. per foot to approximately 1½ in. per foot with a ¼ in. per foot slope preferred, in order to install Galvalume® metal sheets, with framing to be constructed with approximately 4-foot spacing in a most preferred embodiment. Galvalume® metal sheets coated by manufacturers are accompanied by a twenty-year warranty, leading to a long low-maintenance life. The Galvalume® metal sheets are expected to last indefinitely if recoated promptly when needed. Treated wood is then secured as sets of beams 31 using long roof deck screws to the horizontal roof support 30. Sets of beams 31 are connected to one another and to the underlying horizontal roof deck 33 using long roof deck screws. An increased height of sets of beams 31 is used upon the horizontal roof deck 33 proceeding from each of a number of longitudinal outer edges 45 towards a central section 35.

In addition, metal sheets 15 are fastened to the sets of beams 31, said metal sheets 15 inclining from the number of longitudinal outer edges 45 towards the central section 35 of the lower surface 14 of the new roofing system 10 forming a left upper surface 11 and a right upper surface 12. A gap 53 would then exist between opposite pairs of metal sheets 15 running towards the central section 35 from each pair of the number of longitudinal outer edges 45. Sheet rocks 63 (not shown in FIGS. 1–4) comprising plaster boards are placed longitudinally between adjacent metal sheets 15 and between adjacent sets of beams 31 at several places on the horizontal roof deck 33, separating metal sheets 15 from neighboring sets of beams 31. When re-insulation is used, fiberglass insulation of desired thickness (i.e. above approximately 2 inches) is placed directly over the existing horizontal roof deck 33 and between sheet rocks 63.

A number of ridge caps 49 are used to cover the central section 35 which is located between the left upper surface 11 and the right upper surface 12 of the new roofing system 10. Existing skylights are removed. Before installing the number of ridge caps 49, nonfunctioning roof vents are removed and a number of two-way vents 50 for air flow ventilation are added on the number of ridge caps 49 for the transmission of air and moisture. Existing number of two-way vents 50 are then sealed to the new roofing system 10. Air conditioning compressors 58 are set on metal sheets 15 and additional support 59 is supplied under the air conditioning compressors 58, using on-site maintenance staff to assist in handling and location of air conditioning compressors 58.

Existing gutters 22 are removed and matching prefinished compatible gutters 22, preferably box gutters or sculptured gutters, are installed on all four sides of the building, thus surrounding the number of outer borders 21 of the metal sheets 15 by metal gutters 24. By sealing the number of longitudinal outer edges 45 of the lower surface 14 and the number of latitudinal outer edges 46 of the lower surface 14, and the number of inner borders 20 of the metal sheets 15 and the number of outer borders 21 of the metal sheets 15, less chance of entrance of pests and bats into the new roofing system 10 exists. Said metal gutters 24 serve as channels 23 around the upper surface 13 of the new roofing system 10 and around the lower surface 14 of the new roofing system 10. A number of down spouts 26 remain in place and are used when appropriate and when the number of down spouts 26 are still in a functional condition. However, a number of down spouts 26 are supplied in cases when a number of down spouts 26 have to be removed or when a number of down spouts 26 are needed.

As shown by the invention, a more efficient way of reroofing than removing existing roofs is to simply cover existing roofs with the new roofing system 10. A common practice in roofing industry is to remove roof systems prior to reroofing. Removing existing roofs is more expensive since more labor is required. In addition, environmental issues, comprising landfill spaces, disposal costs, and environmental and personal health, accompany removal of tar and gravel. The new reroofing system 10 does not require removal of the existing roofing system, thus deleting removal of tar and gravel which requires additional labor. The new roofing system 10 minimizes production of offensive odors based on components that are utilized (e.g. metal, wood, sealants). In addition, amount of noise is minimized. There is very little disturbance of building grounds during construction. Another advantage of the new roofing system 10 is the fact that the building or its interior are not exposed to weather during installation since the ceiling joists 34 and the horizontal roof deck 33 need not be removed. Thus, construction of the new roofing system 10 tends to create minimal interruption of and interference with use of the building by occupants. In addition, the horizontal roof deck 33 is preserved as a vapor barrier during installation since the horizontal roof deck 33 is not removed or opened. Air conditioning compressors 58 and skylights may stay on the horizontal roof deck 33 during construction and need not be removed, decreasing labor costs to a certain extent and reducing exposure to vandalism. In addition, there is an option of omitting roof skylights on the metal sheets 15, if desired. The new roofing system 10 is relatively easy and less costly to repair than other existing roofs due to the simple arrangement and due to easily replaceable components of the new roofing system 10. The metal sheets 15 are not damaged by rodents and vermin. It is also worthy to note that the new roofing system 15 is very resistant to high winds as all components are fastened together and to the horizontal roof deck 33, preferably by long roof deck screws. Also, the new roofing system 10 is substantially recyclable, if removed.

Covering existing roofs with the new roofing system 10, without removing existing roofs, is less costly. However, if attention is not paid, a large amount of risk may follow, with a major constantly threatening issue being roof collapse due to added weight of the new roofing system 10 and entrapment of moisture within the new roofing system 10. Moisture that is entrapped within the new roofing system 10 is in contact with metallic screws and fasteners and leads to accelerated corrosion of screws and fasteners and thus roof collapse. Said roof collapse would be life threatening and expensive. Issue of roof collapse is specifically difficult to solve since the answer varies from case to case, depending upon original structure design, amount of dead load added since original construction, amount of dead load to be removed, amount of dead load to be added with the new roofing system 10, and elimination of load requirements due to change of roofing (e.g. elimination of ponding, removal of loose gravel), to name a few. Lightweight metal sheets 15 usually weigh less than loose gravel that is removed, thus leading to a reduction of total dead load added upon construction of the new roofing system 10. In addition, roof live load is minimized by eliminating ponding and accumulation of water and other debris on the new roofing system 10. Number of ribs 16 of the metal sheets 15 shed water relatively quickly and uniformly, even on buildings that have become uneven or off-level from settling of foundation. The new roofing system 10 prevents entrance of new moisture and has a slope which creates a ventilated attic space which makes removal of wet insulation from original roof system redundant. In addition, sealants 55 used between the metal sheets 15 and between the number of ridge caps 49 and the metal sheets 15 assist in making the new roofing system 10 moisture-tight. Air moving through said ventilated attic space removes moisture out of attic floor. To determine amount of ventilation necessary, type of insulation material, extent of moisture present, climatic considerations at the project site and corrosion resistance of fasteners used for reroofing are among several factors considered. Haddock, Robert M., "Tear-off or recover? Part II—Can metal roofing dry up ventilation concerns?", RSI, p. 38, August 1994. The lack of moisture in said new roofing system 10 is an additional factor that deteriorates the growth of termites which depend upon moisture for existence.

Other issues exist, as well, which tend to complicate choosing between reroofing with or without tearing the original roof. Roof materials tend to be compressed, settle, move and be deflected due to thermal, elevational, surface and other surrounding effects. Thus, roof surfaces are usually uneven at time of reroofing. Tearing out the original roof minimizes said uneven roof surfaces. It should be noted that one major advantage of metal is that metal is not affected noticeably by thermal, elevational, surface and other similar surrounding effects. In addition, effects in the original uneven roof surfaces may be compensated for by the new roofing system 10 and by the method of reroofing using said new roofing system 10. Therefore, the new roofing system 10 is not effected by any inconsistencies or negative points in the original roof. It might be worth mentioning that the new roofing system 10 is not effected or damaged by foot traffic.

Whether reroofing is performed with tearing the original roof or without tearing the original roof, the roof surface shall be cleaned and all debris removed. Sets of beams of the horizontal roof support are connected by long roof deck screws to the horizontal roof deck. Space is provided for existing electrical conduits that lay on the original roof, thus eliminating a messy accumulation of wires on top of the new roofing system 10. The metal sheets 15 could, thus, be installed without moving the electrical conduits off the horizontal roof deck 33.

As an option, insulation on the horizontal roof deck 33 and between sets of beams 31 of the new roofing system 10 may be deleted in order to provide for free air circulation between the original roof and the new roofing system 10. Air space created by the new roofing system 10 provides insulation to a certain extent, thus leading to a decrease in material, a decrease in installation costs and a decrease in energy loss due to increased insulation. If air space is left between the sets of beams 31, the new roofing system 10 would be obviously less costly in terms of materials. Also, there is an option of reforming existing openings in original roof for ventilation purposes.

After completion of building the new roofing system 10, the upper surface 13 of the new roofing system 10 is cleaned of debris, tools and any remaining material. A final inspection of the new roofing system 10 is required in order to check components and positioning of components of the new roofing system 10. For example, tightness of fasteners 40 should be checked.

It should be noted that although emphasis has been on reroofing of existing buildings, it should be noted that the new roofing system 10 may also be applied to new construction. In general, it is estimated that covering existing roofs with the new roofing system 10 would be a better choice, economically, environmentally, and in relation to health of exposed public, as long as proper care is taken. As can be seen, the method of reroofing using said new roofing system 10 is simple and is, therefore, economical, since it can be built from a relatively small amount of material, labor and skill. The simplicity of the new roofing system 10 enables quick installation of the new roofing system 10 on an original flat or slightly sloped roof with a minimum amount of labor and a minimum amount of material. It should be noted that simplicity of the new roofing system 10 does not result in lowering of performance or efficiency of the new roofing system 10. On the contrary, the new roofing system 10 extends life of air conditioning compressors 58 by reducing heating and cooling load that has to be handled by the air conditioning compressors 58 on a daily basis. Also, with or without use of insulation sheets, air conditioning costs are reduced due to the additional insulation provided by the structure of the new roofing system 10. Actually, high cost maintenance flat roofs are being converted to energy efficient low-sloped metal roofs upon construction of the new roofing system 10. One advantage of the invention is that thermal resistance of the new roofing system 10 is more than that of many existing roofs. The gently-sloped covering of the upper surface 13, said covering most preferably comprising aluminum and zinc, eliminates pooling, insulates the building and is long-lasting. Thus, repair and maintenance costs for air conditioning compressors 58 and for flat roofs are decreased. Also, as shown from the various embodiments described above, the elements can be relatively easily assembled above the upper surface 13. No coatings for protection from rusting is needed for approximately 15 years to approximately 20 years. Still another advantage is that the new roofing system 10 provides a relatively noise-free roofing system. A combination of said advantages creates a higher level of comfort for occupants.

Due to the arrangement of components of the new roofing system 10, the new roofing system 10 is compatible with a large number of different wall structures and different building configurations. The slope of the new roofing system 10 may be easily adjusted by changing height of sets of beams 31. Said new roofing system 10 may be used with roofs having different design specifications and variable overall roof height and variable area coverage. The new roofing system 10 has been used with mansard roofs 80 (refer to FIG. 2) and roofs with parapet walls 60 (refer to FIG. 3). Another advantage is that said new roofing system 10 is versatile and adjustable to meet varying irregularities on original roofs. Due to a distance existing between the metal sheets 15 and the horizontal roof deck 33, some irregularities of the horizontal roof deck 33 are not noticeable on the metal sheets 15. The new roofing system 10 is also adjustable to provide the desired drainage slope. The new roofing system 10 maintains an attractive aesthetically pleasing appearance while allowing expansion and contraction, withstanding wind uplift, maintaining watertight integrity and being economical and environmental friendly. Metal gutters 24 assist in cleaning up and enhancing the number of outer edges 44 of the lower surface 14 of the new roofing system 10. The new roofing system 10 is recyclable if removed and has no offensive odors as tar and gravel roofs do. Most importantly, once the new roofing system 10 is installed, it requires minimal maintenance. Also, sheet rocks 63 (not shown in FIGS. 1–4) act as fire walls which reduce to a great extent horizontal air movement under the metal sheets 15, thus reducing possibility of travel of fire horizontally under the metal sheets 15. The use of the new roofing system 10 also diminishes potential of lightning damages to the building.

Although the new roofing system 10 is neither recommended over multiple systems that may have trapped water nor adaptable to roofs with large air handler units or large units of roof equipment, the new roofing system 10 has numerous significant advantages over many leading systems presently used in the market for roofing flat or slightly sloped roofs. As a result of said advantages, the new roofing system 10 is competitively priced and has low annual costs.

Certain objects are set forth above and made apparent from the foregoing description to describe a certain construction and method of developing said construction. However, since certain changes may be made in the above construction or method without departing from the scope of the invention, it is intended that all matters contained in the foregoing construction or method or shown in the accompanying drawings shall be interpreted as illustrative only of the principles of the invention and not in a limiting sense. With respect to the above description then, it is to be realized that the optimum dimensional relationships for the parts of the invention, to include variations in size, materials, shape, form and manner of operation, assembly and use, are deemed readily apparent and obvious to one skilled in the art, and all equivalent relationships to those illustrated in the drawings and described in the specification are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall therebetween.

What is claimed as invention is:

1. A new roofing system for protecting flat roofs or slightly sloped roofs, said new roofing system comprising:

a. an upper surface, including a left upper surface and a right upper surface, a lower surface, and a central section;

b. a horizontal roof deck being attached to a ceiling joist and serving as the lower surface, said lower surface having a number of outer edges comprising a number of longitudinal outer edges and a number of latitudinal outer edges;

c. a horizontal roof support comprising sets of beams placed longitudinally on the horizontal roof deck, with each set of beams located at a specified distance from an adjacent set of beams and containing an increased amount of material than a previous set of beams as one proceeds towards the central section from each of the number of longitudinal outer edges of the lower surface;

d. metal sheets serving as the upper surface and having a perimeter with a number of inner borders and a number of outer borders, with the number of inner borders being borders of the metal sheets which are located adjacent to a neighboring metal sheet and with the number of outer borders being borders of the metal sheets which are located adjacent to metal gutters or adjacent to troughs;

e. fasteners, comprising deck screws, long deck screws and metal-to-wood screws;

f. a number of ridge caps, with a left end and a right end, used to serve as a connection between opposite pairs of metal sheets running from opposite pairs of the number of longitudinal outer edges of the lower surface to the central section;

g. a number of two-way vents, located under each of the number of ridge caps, said number of two-way vents permitting a flow of air and moisture under the metal sheets and under the number of ridge caps;

h. channels, comprising gutters, metal gutters and troughs, running along the number of outer borders of the metal sheets and connected to down spouts located around a building;

i. sealants to avoid entrance of extraneous material under the metal sheets through the number of outer edges of the lower surface; and j. air conditioning compressors set on top of support for said air conditioning compressors, said support comprising pieces of wood and being placed above the metal sheets;

such that the metal sheets are fastened by fasteners to the horizontal roof support, and thus to the horizontal roof deck, with the horizontal roof support being laid down between each of the number of longitudinal outer edges of the lower surface and the central section of the new roofing system, in order to establish a desired slope; and such that the sealants are used to seal the number of two-way vents, other vents and air conditioning compressors to the new roofing system, used between the metal sheets and the number of ridge caps, used between the metal sheets and the channels, and used among pairs of the metal sheets to assist in making the new roofing system secure against moisture, debris and winds.

2. The new roofing system of claim 1, wherein the metal sheets comprise a number of ribs laid at specified distances from each other, giving the metal sheets a series of elevated sections with a shallow section located between each pair of said series of elevated sections.

3. The new roofing system of claim 1, wherein the sets of beams include but are not limited to metallic beams and beams made of treated wood comprising plywood.

4. The new roofing system of claim 1, wherein rubber-washers are placed around fasteners for protection against entrance of water.

5. The new roofing system of claim 1, wherein the sealants, comprising mastic materials, elastomeric roof caulks, and cloth reinforcement, serve to fasten edges of the metal gutters to the number of outer borders of the metal sheets, to edges of the left upper surface and edges of the right upper surface, and to the number of longitudinal outer edges and to the number of latitudinal outer edges of the lower surface in order to prevent leakage under the new roofing system, and to fasten the number of outer borders and the number of inner borders of the metal sheets of the new roofing system to protect the system from entrance of water and other extraneous matter.

6. The new roofing system of claim 1, wherein the channels are used as troughs for roofs with parapet walls.

7. The new roofing system of claim 1, wherein metal sheets are curved and tapered at the number of outer edges of the lower surface, thus requiring that metal sheets used at gable sides of the building differ in shape and size from other metal sheets in order to accommodate for increasing height of the new roofing system.

8. The new roofing system of claim 1, wherein steel, as a component of steel sheets, including but not limited to Galvalume® metal sheets which have a coating of a corrosion-resistant aluminum-zinc alloy, is used as a light gauge substructural component to create a slope above a previously existing horizontal roof deck of a building, and usage of Galvalume® metal sheets to overlay existing gravel roofs requires a slope ranging from approximately ¼ in. per foot to approximately 1½ in. per foot from the central section toward front of the building and toward back of the building.

9. The new roofing system of claim 1, wherein the sets of beams are located at intervals ranging from approximately 2 ft. to approximately 4½ ft. from adjacent sets of beams of said horizontal roof support.

10. The new roofing system of claim 1, wherein the upper surface of the new roofing system has a slope ranging from approximately ⅛ in. per foot to approximately ½ in. per foot, with an increase in slope being directly proportional to an increase in material consumed for construction, and thus directly proportional to cost of material.

11. The new roofing system of claim 1, wherein coated metal sheets are used as a component of the new roofing system to create a slope above a previously existing flat roof surface and to be fixed to the horizontal roof deck, with a space existing between the coated metal sheets and the horizontal roof deck and a volume existing between each adjacent pair of sets of beams of the horizontal roof support which are fastened between the horizontal roof deck and the metal sheets, said volume increasing as the central section of the new roofing system is approached from the number of longitudinal outer edges of the new roofing system.

12. The new roofing system of claim 11, wherein said channels neighboring any outer borders of the metal sheets are not shared with other adjacent, attached roofs, including but not limited to channels used in mansard roofs and parapet walls.

13. The new roofing system of claim 11, wherein when construction of the new roofing system begins:

(a) an original roof exists which serves as the lower surface of the new roofing system, thus making construction of a lower surface redundant; and (b) existing skylights, existing gutters and nonfunctioning vents from the original roof are removed.

14. A method of application of a new roofing system to a building for protecting flat or slightly sloped roofs, said method comprising:

(a) removing and relocating debris, including but not limited to leaves and loose roof gravel, from top of a building;

(b) using a horizontal roof deck as a lower surface of said new roofing system;

(c) fastening a horizontal roof support to said horizontal roof deck and to any ceiling joists lying under the horizontal roof deck, using fasteners;

(d) fastening metal sheets to the horizontal roof support using fasteners, said metal sheets inclining upwardly from a number of longitudinal outer edges of the lower surface towards a central section of the new roofing system forming a left upper surface and a right upper surface, with a gap existing at the central section between the left upper surface and the right upper surface of the new roofing system;

(e) using a number of ridge caps to cover said gap at the central section which is located between the left upper surface and the right upper surface after having placed a number of two-way vents for transmission of air and moisture at the central section of said new roofing system;

(f) setting air conditioning compressors above metal sheets after supplying additional support under said air conditioning compressors and above said metal sheets;

(g) sealing existing functional vents, and additional vents that are needed, to the metal sheets at the left upper surface and at the right upper surface of the new roofing system and sealing the number of two-way vents on the number of ridge caps;

(h) attaching prefinished compatible channels to a number of outer edges of the lower surface of the new roofing system such that said channels neighbor any outer borders of the metal sheets, utilizing a number of down spouts when appropriate and supplying a number of down spouts when needed and connecting said number of down spouts to the channels; and (i) cleaning the left and right upper surface of the new roofing system of debris, tools and any remaining material and performing a final inspection of the new roofing system;

such that the new roofing system is attached to the building.

* * * * *